US005579694A

United States Patent [19]

Mailloux

[11] Patent Number: 5,579,694

[45] Date of Patent: Dec. 3, 1996

[54] PRINTER ADAPTED FOR USE WITH SILICA-BASED PRINT MEDIA

[75] Inventor: Dennis R. Mailloux, Westminster, Mass.

[73] Assignee: Polaroid Corporation, Cambridge, Mass.

[21] Appl. No.: 520,851

[22] Filed: Aug. 30, 1995

[51] Int. Cl.[6] ..... B41L 35/14; G03G 15/20

[52] U.S. Cl. ..... 101/488; 355/285; 430/126

[58] Field of Search ..... 101/488; 355/285, 355/286, 287, 288, 289, 290, 291, 279, 284; 428/216, 36.5; 430/126

[56] References Cited

U.S. PATENT DOCUMENTS

| | | | |
|---|---|---|---|
| 5,055,371 | 10/1991 | Lee et al. | 430/126 |
| 5,123,151 | 6/1992 | Uehara et al. | 355/284 |
| 5,153,656 | 10/1992 | Johnson et al. | 355/285 |
| 5,264,902 | 11/1993 | Suwa et al. | 355/285 |
| 5,277,965 | 1/1994 | Malhotra | 428/216 |
| 5,281,504 | 1/1994 | Kanbayashi et al. | 430/99 |
| 5,327,202 | 7/1994 | Nami et al. | 355/285 |
| 5,353,107 | 10/1994 | Sculley et al. | 355/285 |
| 5,363,180 | 11/1994 | Shimizu | 355/285 |
| 5,448,339 | 9/1995 | Kokaji et al. | 355/285 |
| 5,451,466 | 9/1995 | Malhotra | 428/195 |
| 5,468,553 | 11/1995 | Kikukawa et al. | 428/36.5 |
| 5,481,346 | 1/1996 | Ohzeki et al. | 355/285 |

*Primary Examiner*—Eugene H. Eickholt
*Attorney, Agent, or Firm*—Christopher P. Ricci

[57] ABSTRACT

An adaptation of a commercially-available printer designed for use with cellulose-based print media is described which transforms the commercially-available printer into a printer that can print on silica-based print media. The printer has an increased heat differential between fuser rollers which are lined with a substantially non-porous elastomeric material to increase release characteristics. The fuser oil assembly is also adapted so as to substantially increase an amount of oil deposited onto the fuser rollers, thereby further increasing release characteristics of the fuser rollers and decreasing adhesion to the silica-based print media.

8 Claims, 3 Drawing Sheets

PRINTER ADAPTED FOR USE WITH SILICA-BASED PRINT MEDIA

BACKGROUND OF THE INVENTION

The present invention relates to printers which are peripherals to computers and, more particularly, to printers adapted for use with silica-based print media.

Cellulose-based print media such as common paper, for example, have long been used as a media of choice for printing. Cellulose-based print media have qualities such as low cost, flexibility and low porosity, that make it amenable to generalized printing. In making identification cards though, other criteria become more desirable. These qualities include a high shear strength, an affinity to form mechanical and chemical bonds with toners and adhesives, and moisture resistance for example. These qualities are not strengths of cellulose-based print media, but are qualities of silica-based print media.

With the wide usage of cellulose-based print media there has evolve a variety of printers for use with computers which print images transmitted from the computer onto cellulose-based print media. A printer of this type generally includes at least a paper feeder to feed the cellulose-based print media into the printer, transfer system to apply the toner to the cellulose-based print media in a manner dictated by the image, and fixing system for securing the toner to the cellulose-based print media. These sub-systems perform their tasks in accordance with the print media under an assumption that the print media is cellulose-based, i.e., if the printer is not designed for use with plastic sheets then the plastic sheet may not feed, receive the toner or bond with the toner well.

Therefore, a problem with such printers is that they are restricted to use with such cellulose-based print media. Printing on the aforementioned silica-based print media on one of these commercially-available printers is then virtually impossible due to the characteristics of silica-based print media. For silica-based print media, these problems are primarily manifested in the fixing system. The fusing oil that is applied in a printer for cellulose-based print media applies a coat of oil on fusing rollers immediately prior to receipt of the cellulose-based print media and then withdraws. The silica-based print media is far more porous than cellulose-based print media and absorbs fusing oil much faster. Therefore, a fusing oil dispersing assembly designed for a cellulose-based print media disperses an amount of fusing oil inadequate for printing on a silica-based print media.

Further, fuser rollers in the fixing system have a heat differential that assists in bonding the toner to the cellulose-based print media. The heat in the fuser roller emanates from an internal heating element out through a liner on the fuser roller which is extremely smooth for a glossy finish on printed output. The heat differential brings with it an additional problem for silica-based print media. The heat differential is minimal for cellulose-based print media since the cellulose-based print media does not have a substantial tendency to adhere to the fuser rollers. Contrarily, silica-based print media adheres in the presence of heat and toner with its thermoplastic components augment this adhesion. Therefore, heating the silica-based print media in this way causes the silica-based print media to stick to the fuser rollers and curl around them, thus jamming the printer and ruining the printed output.

The liner on the fuser roller can also be problematic. With the increased porosity of the silica-based print media there is more air trapped in the media as it passes between the fuser rollers which are applying a substantial inward pressure. The liner having a slick, polished surface sticks to the silica-based print media due to vacuum, i.e., a suction-cup effect.

Accordingly, it is an object of this invention to adapt a commercially-available printer designed to print on cellulose-based print media to print on silica-based print media.

It is another object of this invention to provide additional fusing oil to a silica-based print media in a commercially available printer.

It is still another object of this invention to adjust the heat differential at the fuser rollers to decrease adhesion to a surface opposed to the toner in a silica-based print medium.

It is a further object of this invention to adapt the fuser roller liner on the fuser rollers such that they have additional release characteristics such that silica-based print media do not stick to the liner.

These and other objects of the invention will be obvious and appear hereinafter.

SUMMARY OF THE INVENTION

The aforementioned and other objects of the invention are achieved by the invention which provides a printer adapted for use with a silica-based print media. The printer is adapted for printing images transmitted by a computer onto the silica-based print media by utilizing a feeding means, a transfer means, a fixer means, and a transport means.

The feeding means draws the silica-based print media into the printer and places the silica-based print media into the transfer means. The transfer means then deposits toner onto the silica-based print media such that the image is formed as dictated by data transmitted from the computer.

The fixer means creates a heat differential between a top and a bottom fuser roller across the silica-based print media which passes therethrough. The toner is thus bonded to the silica-based print media by the heat differential. In order to avoid an adhesion effect from sticking to the fuser rollers while passing through the heat differential, a material comprising a liner of the fuser rollers is altered such that it has an increased release characteristic.

The material is also left having a grossly smooth surface, or rough relative to an original fuser roller material, such that a matte finish is achieved. The unsmooth surface increases penetration of ambient gases, air for example, through natural channels such that the ambient gases pass into along the surface of the liner of the fuser rollers decreasing a vacuum effect between the fuser roller and the silica-based print media.

Additional oil is also placed on the fuser roller by an oil roller which is in constant mechanical contact with the fuser rollers to decrease adhesion to the fuser rollers by the toner and the silica-based print media. Thus, the silica-based print media is transported by the transport means out of the printer with the toner fused thereto.

In further aspects, the invention provides methods in accordance with the apparatus described above. The aforementioned and other aspects of the invention are evident in the drawings and in the description that follows.

BRIEF DESCRIPTION OF THE DRAWINGS

The foregoing and other objects of this invention, the various features thereof, as well as the invention itself, can be more fully understood from the following description, when read together with the accompanying drawings in which.

DETAILED DESCRIPTION

While the present invention retains utility within a wide variety of printers and may be embodied in several different forms, it is advantageously employed in connection with a four-color printer depositing red, green, blue, and black to form an image. In the illustrated embodiment, the printer adapted for this task is a Canon Color Laser Copier 550. Though this is the form of the illustrated embodiment and are described as such, this embodiment should be considered purely illustrative and not restrictive.

Figure 1:
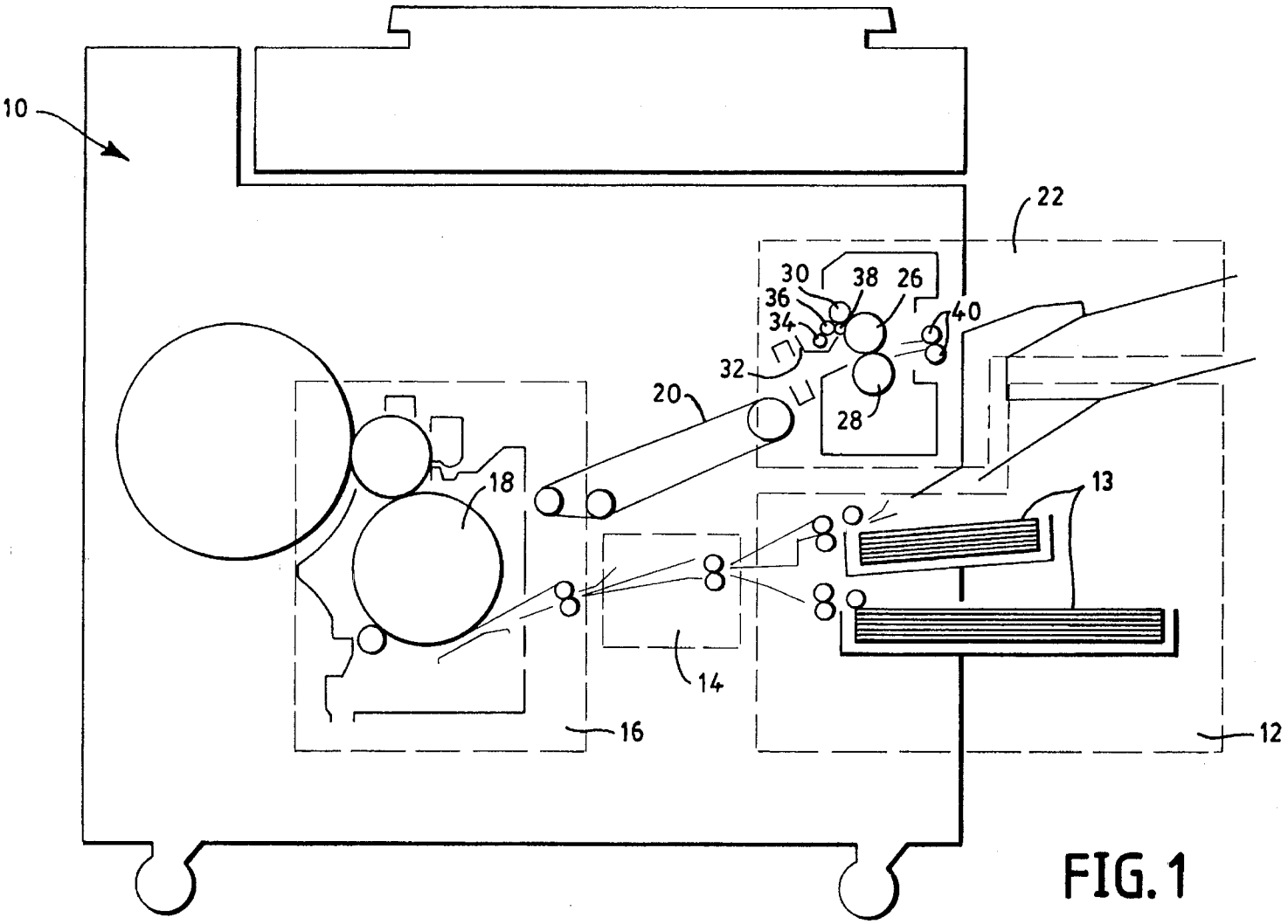
FIG. 1 is a cross-sectional view of a printer adapted in accordance with the invention.

Referring now to FIG. 1, a printer 10 is shown adapted to print an image communicated from a computer on silica-based print media. The printer 10 has a feeder unit 12 which feeds a silica-based prim medium 13 into the printer 10. In the preferred embodiment, the silica-based print medium 13 is a sheet of TESLIN which is a trademark of Pittsburgh Plate Glass, Inc. Sheets of the silica-based print medium 13 are held in trays which are removable from the printer 10 to refill in a way commonly known in the art. Individual sheets of the silica-based print medium 13 are then fed into a transport unit 14 which transports the print medium 13 into a transfer unit 16.

In the transfer unit 16, the silica-based print medium 13 contacts an image drum 18 which deposits toner thereon. The image drum 18 of the illustrated embodiment has four layers of color toner which have been placed thereon by a xerographic process commonly known in the art. It should be noted that the process described herein is also applicable to monochromatic as well as toner systems utilizing processes other than xerographic. Due to the xerographic process, the toner electrostatically bonds to the silica-based print medium 13. The silica-based print medium 13 is then placed on a conveyor belt 20 which transports the silica-based print medium 13 into a fixing and delivery unit 22.

A top fuser roller 26 and a bottom fuser roller 28 within the fixing and delivery unit 22 begin to rotate in anticipation of receiving the silica-based print medium 13. This rotation begins when the silica-based print medium 13 is being processed, even before imaging occurs in the transfer unit 16. The top fuser roller 26 is in contact with an oil roller 30 as the top fuser roller 26 turns. The oil roller 30 receives oil through a series of first, second, and third oil pickup rollers 34, 36, 38 which draw oil from an oil tray 32.

The bottom fuser roller 28 is also oiled by the aforementioned oil assembly. As the fuser rollers 26, 28, rotate there is mechanical contact between them. Therefore, oil is transferred from the top fuser roller 26 to the bottom fuser roller 28 while the print medium 13 is not present therebetween.

In a printer for use with cellulose-based print media, the oil requirements are minimal and, therefore, contact with the oil roller 30 is initiated only moments before introduction of the print medium. Once the print medium 13 is present in the fixing and delivery unit 22, the printer 10 withdraws the oil roller 30 from contact with the top fuser roller 26.

In contrast, the printer 10 of the invention for use with silica-based print media must apply a much larger quantity of oil to ensure that the silica-based print medium 13 does not adhere to the fuser rollers 26, 28. Therefore oil is continuously applied to the top fuser roller 26 and is absorbed by the print medium 13 in order that print medium 13 does not stick to the fuser roller 26 during the heat bonding process.

The heat bonding process uses the top fuser roller 26 and the bottom fuser roller 28 which have a heat differential therebetween such that thermoplastic properties of the toner increase bonding strength to the silica-based print medium 13. This serves to fix, or bond, the toner to the silica-based print medium 13.

The print medium 13 then passes through outfeed rollers 40 onto outfeed trays 24 to complete delivery of the imaged print medium 13.

In the aforementioned example such a printer 10 is used for generation of identification cards, an additional laminate is then applied around the card. The high porosity of the silica-based print medium 13 increases mechanical and chemical bonds with the toner as well as mechanical bonds with the laminate making separating the laminate from the card virtually impossible without destroying the card itself. Further, the high shear strength of silica-based print medium 13 makes tearing the card extremely unlikely.

Figure 2:
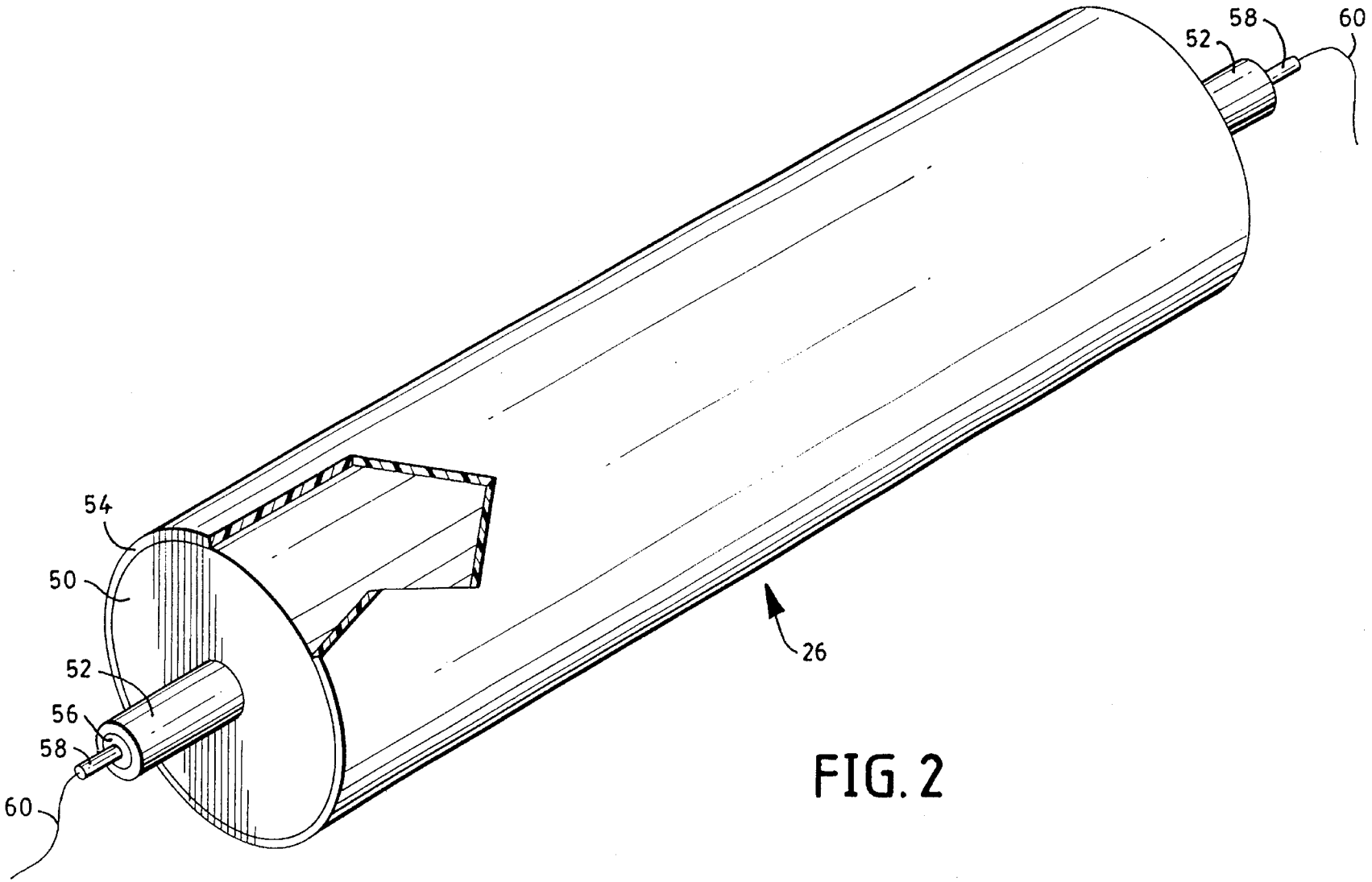
FIG. 2 is a cutaway perspective view of a fuser roller from the printer according to FIG. 1.

FIG. 2 shows a fuser roller such as those described above. The fuser roller of the Figure is the top fuser roller 26 but can also be the bottom fuser roller 28 with a slight adaptation described hereinafter. The top fuser roller 26 has a roller body 50 having a cylindrical shape elongated about a central axis and a liner 54 which covers a surface of the roller body 50. Projecting from the roller body 50 is a roller stem 52 which mechanically connects to the printer 10 such that the fuser roller 26 is rotated by a motor (not shown) in the printer 10.

In prior art embodiments of the fuser roller, an original liner is a highly-polished material often fabricated of rubber coated with TEFLON, a trademark owned by E.I. DuPont de Nemours & Co., Inc. The original liner is removed for use with a silica-based print media and is replaced with a substantially non-porous elastomeric material. In the preferred embodiment, a silicon rubber is used to fabricate the liner 54 due to its high release characteristics. The surface of the liner 54 is made grossly smooth in that it is not polished to transmit a high gloss finish to the silica-based print medium 13 but is instead left such that a matte surface is obtained, thereby allowing transmission of ambient air into the liner 54 thus reducing vacuum effects between the print media and the liner 54.

To attain the heat differential previously described, the roller body 50 is heated by a heating element 56 which passes into an interior portion of the roller body 50 through a bore along a central axis of the roller body 50. The heating element 56 has a lead 58 projecting therefrom, to which a power wire 60 is connected. A supply voltage to the lead 58 energizes heating element 56 which projects into the roller body 50 generating a thermal output thus heating the roller body 50. In this adaptation of a commercially-available printer, the bottom fuser roller 28, which is likewise heated in commercial embodiments, has the heating element 56 disconnected by either removal of the heating element 56 or by creating a discontinuity in the power wire 60. Thus, the heat differential between the top fuser roller 26 and the bottom fuser roller 28 is dramatically increased and thermal radiation is restricted to a surface of the silica-based print medium 13 having toner deposited thereon. By doing so, bond strength of the toner to the silica-based print media is increased by increased mechanical adhesion to the pores of the silica-based print media, and sticking to the lower fuser roller 28, which has less fusing oil 62 on it, is eliminated because adhesion to the cooler bottom fuser roller 28 is less than to the hotter top fuser roller 26.

Figure 3:
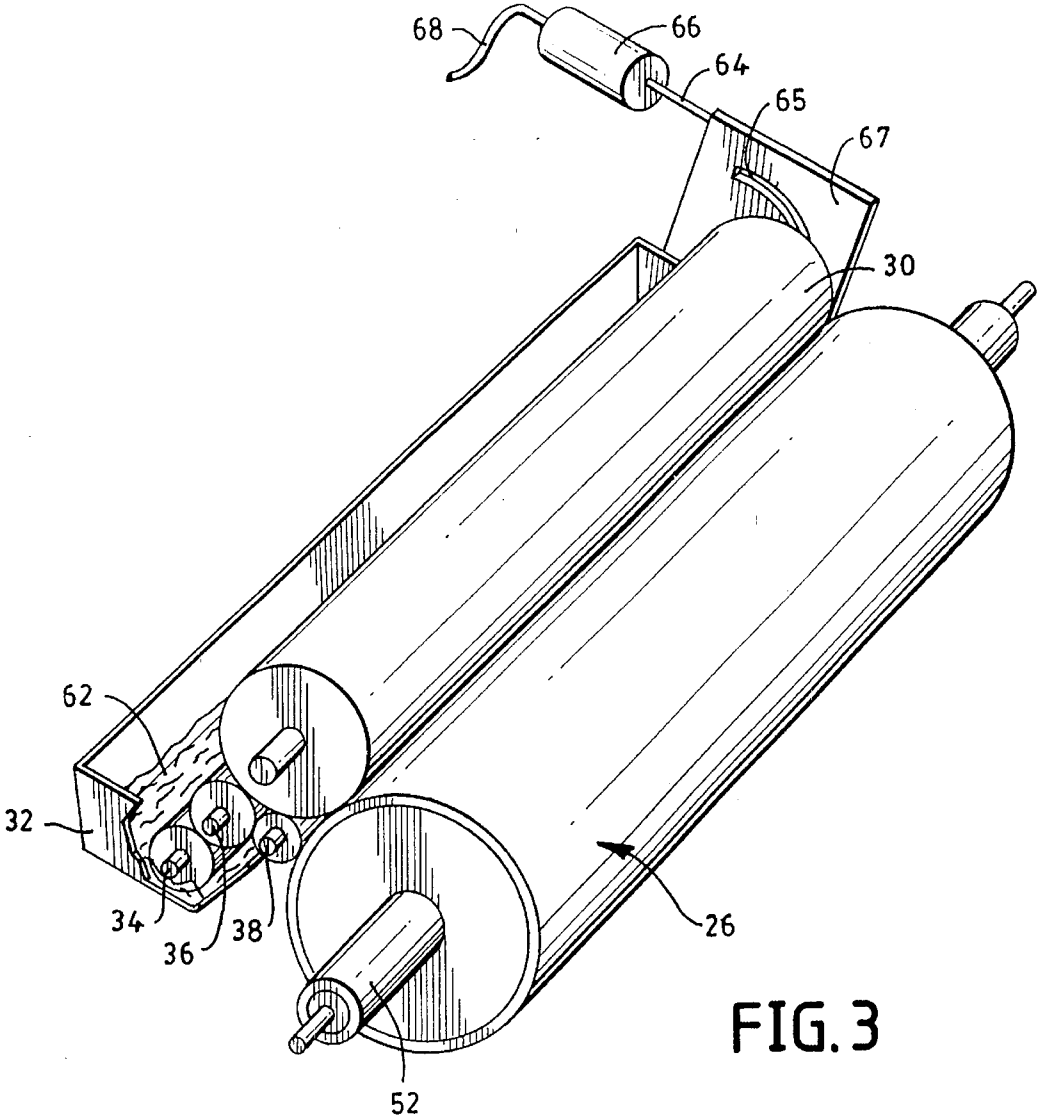
FIG. 3 is a perspective view of the fuser roller of FIG. 2 with an oil-depositing assembly of the printer of FIG. 1.

Referring now to FIG. 3, an oil-depositing assembly is shown in contact with the top fuser roller 26. The oil-depositing assembly draws oil 62 from the oil tray 32 during rotation of the top fuser roller 26. It does so by immersing a first oil pick-up roller 34 in the oil 62, which rotates and transmits the oil 62 to a second oil pick-up roller 36. The second oil pick-up roller 36 is in contact with both a third oil pick-up roller 38 and an oil roller 30. The third oil pickup roller 38 reduces drippage and thus increases surface contact with the oil roller 30 which then deposits the oil 62 onto the outer surface of the liner 54 of the top fuser roller 26.

The oil 62 lightly coats both fuser rollers 26, 28. The oil 62 interferes with adhesion of the hot silica-based print medium 13 to the fuser rollers 26, 28 and of the toner to the top fuser roll 26. To further decrease adhesion, the top fuser roller 26 gets continued oiling throughout the bonding process. The mechanical interaction between the top and bottom fuser rollers 26, 28 is interrupted through due to the presence of the silica-based print medium 13 and, therefore, oil 62 to the bottom fuser roller 28 is discontinued. This is of limited consequence though since in this embodiment only a top portion of the silica-based print medium 13 has toner and the top portion is in contact with the top fuser roller 26. If double-sided printing were enabled then an additional mechanism for continuously oiling the bottom fuser roller 28 would be used.

As the top fuser roller 26 rotates, the oil roller 30 deposits oil 62 thereon. When a print medium 13 is not present between the top fuser roller 26 and the bottom fuser roller 28, substantially all of the oil 62 is transmitted to the bottom fuser roller 28. Once a print medium 13 is present, the top fuser roller 26 retains the oil 62 and, therefore, both top and bottom fuser rollers 26, 28 are oiled during the fusing process, although oil 62 on the bottom fuser roller 28 gets depleted by the absorptive silica-based medium 13.

Commercially-available printers, as previously described, are designed for use with cellulose-based print media such as paper. Paper is less porous than the silica-based print medium 13 and therefore requires less oil 62. In the commercially-available embodiments, the oil roller 30 only contacts the top fuser roller for a fixed duration and is, therefore, retracted from the top fuser roller 26 when a print medium 13 is not present, thereby decreasing an amount of oil 62 deposited thereon. This is accomplished by using a solenoid 66 which is a retractable switch which uses a magnetic field to draw a shaft 64 inward when powered from an outside power source through a power wire 68. When the shaft 64 is drawn inward by the solenoid 66, the oil roller 30 travels along a track 65 in a guide plate 67, such that mechanical contact with the top fuser roller 26 is interrupted. In the invention, the solenoid 66 is disabled, such that the oil roller 30 is in continuous mechanical contact with the top fuser roller 26, thus substantially increasing an amount of oil 62 communicated to the top fuser roller 26 and ultimately on the bottom fuser roller 28. Alternatively, the solenoid 66 or any of the various other elements of the retraction system can be disabled or removed thus accomplishing the same goal.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method for adapting a conventional printer to print on a silica-based medium, the conventional printer being adapted to print images transmitted from a computer and having a fixing unit for bonding a toner to a cellulose-based print medium; the bonding being at least partially accomplished using a top fuser roller and a bottom fuser roller where each of the top fuser roller and the bottom fuser roller enclose a top heating element and a bottom heating element, respectively, and the top fuser roller and the bottom fuser roller each having a roller body elongated about a central axis and having a first liner covering the roller body; the fixing unit further having an oil depositing assembly for depositing oil with an oil roller onto the top fuser roller for a fixed duration prior to receipt of the cellulose-based print medium by the fixing unit and having a retraction system for withdrawing the oil roller from the top fuser roller after the fixed duration; said method comprising a step of disabling the bottom heating element in the bottom fuser roller thus discontinue thermal radiation from the bottom heating element and decreasing heat propagation to a bottom portion of the silica-based medium.

2. The method of claim 1 further comprising a step of replacing the first liner with a second liner having a high release characteristic so as to inhibit adhesion to the toner and the silica-based print medium.

3. The method of claim 2 wherein the second liner is fabricated from a substantially non-porous elastomer.

4. The method of claim 2 wherein the second liner has a grossly smooth surface having channels allowing movement of ambient gases between the second liner and the silica-based print medium thus substantially inhibiting adhesion due to vacuum.

5. The method of claim 1 further comprising a step of disabling the retraction system such that oil is continuously communicated to the top fuser roller by the oil roller.

6. The method of claim 1 further comprising a step of removing the retraction system or an element thereof such that oil is continuously communicated to the top fuser roller by the oil roller.

7. A printer adapted to print an image communicated from a computer onto a print medium, the printer comprising feeding means for drawing the print medium into the printer;

transfer means for depositing toner onto the print medium such that the image is formed thus producing an imaged print medium;

fixer means for securing the toner to the imaged print medium, an improvement to the fixer means comprising a top fuser roller and a bottom fuser roller each having a cylindrical fuser body and a liner where the liner is fabricated from a substantially non-porous elastomer having a grossly smooth surface having channels allowing movement of ambient gases between the second liner and the print medium thus substantially inhibiting adhesion due to vacuum and thermal radiation from the top fuser roller and the bottom fuser roller is restricted to a surface of the imaged print medium having toner deposited thereon; and transport means for transporting the prim medium out of the printer.

8. A printer adapted for printing an image transmitted by a computer onto a silica-based print medium, said printer comprising feeding means for drawing the silica-based print medium into the printer, transfer means for depositing toner onto the silica-based print medium such that the image is formed on the silica-based print medium;

fixer means for creating a heat differential between a top fuser roller and a bottom fuser roller where the silica-based print medium passes between the top fuser roller and bottom fuser roller such that heat bonds the toner therto and the heat differential inhibits adhesion of the silica-based print medium to the top fuser roller and the bottom fuser roller, the top fuser roller in the fixer means comprises a cylindrical roller body elongated about a central axis of rotation and having a bore passing therethrough along the central axis, and a liner covering an outer surface of the cylindrical roller body where the liner is fabricated to have a grossly smooth surface forming passages for ambient gases such that during mechanical contact with the silica-based print medium the ambient gases readily pass along the grossly smooth surface thus inhibiting a vacuum between the silica-based print medium and the grossly smooth surface; and transport means for transporting the silica-based print medium out of the printer.

* * * * *